US006506093B2

(12) United States Patent
Avital

(10) Patent No.: US 6,506,093 B2
(45) Date of Patent: Jan. 14, 2003

(54) MINIATURE PUPPET THEATER AND BOOK COMBINATION AND CASE FOR STORING AND TRANSPORTING THE SAME

(76) Inventor: Ami Avital, 10 Lodg, Tel-aviv (IL), 69709

( * ) Notice: Subject to any disclaimer, the term of this patent is extended or adjusted under 35 U.S.C. 154(b) by 0 days.

(21) Appl. No.: 09/867,334

(22) Filed: May 29, 2001

(65) Prior Publication Data

US 2002/0182973 A1 Dec. 5, 2002

(51) Int. Cl.[7] ..... A63J 19/00

(52) U.S. Cl. ..... 446/83; 446/82; 446/72; 40/421

(58) Field of Search ..... 446/82, 83, 84, 446/147, 71, 72, 80, 327; 40/421, 726, 725, 536

(56) References Cited

U.S. PATENT DOCUMENTS 997,342 A * 7/1911 Thompson ..... 40/726
1,490,295 A * 4/1924 Stephens ..... 446/147
1,992,487 A * 2/1935 Jones ..... 40/725
2,084,308 A * 6/1937 Behr ..... 206/214
2,795,067 A * 6/1957 Walker ..... 40/365
3,961,426 A * 6/1976 Wallace ..... 434/73
4,075,780 A * 2/1978 Linebaugh ..... 446/143
4,508,515 A * 4/1985 Skolnick ..... 446/148
5,575,094 A * 11/1996 Leake et al. ..... 40/124.09

FOREIGN PATENT DOCUMENTS

WO WO 89/00877 * 2/1989

* cited by examiner

*Primary Examiner*—Jacob K. Ackun
*Assistant Examiner*—Bena B. Miller
(74) *Attorney, Agent, or Firm*—Adams & Wilks

(57) ABSTRACT

A miniature puppet theater and book combination comprises a housing defining a stage and having collapsible front, side, rear and lower panels. At least one puppet-like object is displaceable on the stage of the housing in the manner of a puppet show. A book whose contents are related to the appearance of the puppet-like object is connected to the housing so that the front, side, rear and lower panels of the housing are collapsible together with the book into a relatively flat compact structure.

19 Claims, 4 Drawing Sheets

MINIATURE PUPPET THEATER AND BOOK COMBINATION AND CASE FOR STORING AND TRANSPORTING THE SAME

BACKGROUND OF THE INVENTION

1. Field of the Invention

The present invention relates generally to educational or entertainment devices and, more particularly, to a miniature puppet theater and book combination and to a case for storing and transporting the same.

2. Background of the Invention

A significant problem in today's modern society is developing a child's reading and thinking skills. Television and video games, which consume a large portion of a child's free time, do not develop these skills.

A significant portion of a child's intellectual capacity, and a child's ultimate desire to engage in intellectual activities, is determined within the first years of life. It is important, therefore, to encourage a child to read and develop intellectual skills at a very early age.

Keeping a child interested in reading, especially during the early years, is often difficult. New and innovative means for peaking a child's interest in reading, such as exciting book material, are needed.

Further, children need to "play" in order to develop both their motor skill, and their intellectual capacity through their sense of imagination. This "play" is useful in developing a child's oral skills as well, as the child normally talks and makes other sounds while acting out various scenarios.

Puppet figures have proven useful in prompting the desired "play" activities. Puppet theater is thought to have its origins in the orient about 4000 years ago. It migrated from the orient and flourished in the early Mediterranean civilizations. Wandering showmen of the Middle Ages used puppet theater as an entertainment medium while churches of the Middle Ages used it to portray the scriptures. Since the Renaissance, puppet theater has been an established form of entertainment in Europe from where, in the nineteenth century, emigrants brought it to North America.

Thus, puppet figures and puppet shows have long been known and the effectiveness of the use of puppet figures to capture the attention and imagination of children has long been recognized. Children's books of the conventional form have, of course, also long been known although the difficulty of maintaining the interest of a very young child for an extended period while the conventional form of book is being read to the child is generally recognized. Indeed, it is difficult to maintain a child's interest in reading books, particularly with television and video games competing for the child's time.

When puppet figures are combined with a book, the text of the book may be used to define the puppet figure's character. The combination of a puppet figure and a book is exemplified by U.S. Pat. No. 3,918,180 where three-dimensional puppet figures extend through openings in the pages. However, because the book and the puppet figures are visibly connected, the puppet figures become a demonstrable extension of the book and loses the potential of being a completely independent entity, i.e., it can not be the essence of a character. Furthermore, since the puppet figures are disposed in aligned slots which are located in the pages of the book, the amount of surface area on the pages available for words or illustrations is reduced. Furthermore, the puppet figures must be relatively small if a substantial amount of printing or illustration is to be placed on the pages of the book without inconveniently increasing the size of the book. Therefore, the puppet figure is not large enough for a child to manipulate by using an entire hand.

Moreover, puppet shows are normally performed in puppet theaters or on puppet stages of appropriate size, and two forms of finger puppetry are disclosed in U.S. Pat. Nos. 2,187,407 and 2,621,440. Animated books are also known, such as that disclosed in U.S. Pat. No. 1,139,643 wherein various animal figures or the like are folded between the pages of book to automatically unfold when the pages of the book are turned. Additionally, books in which the fingers of the reader are inserted through holes in the pages thereof to portray anatomical portions of persons or animals pictured on the pages of the book are also known.

Moreover, while miniature theaters are known, such as the doorway puppet stage disclosed in U.S. Patent No. 2,834,150, there remains a need for a truly portable miniature theater which can be economically manufactured and yet be readily set up and stored by children.

Heretofore, puppet figures, books and a theater stage have not been combined in a structure that maximizes the potential and recognized advantages of the puppet figures, the books and the theater stage.

The present invention overcomes many of the disadvantages inherent in the foregoing conventional art of educational or entertainment devices.

SUMMARY OF THE INVENTION

It is an object of the present invention to provide a miniature puppet theater and book combination for hand actuated puppet figures adapted to be manipulated on a stage structure while reading a book such that the movement of the puppet figures may be used to capture and maintain the attention of a young child being read to.

Another object of the present invention is to provide a miniature puppet theater and book combination which permits a larger amount of visual or illustrative material to be presented on pages of a book and on a stage structure without interruption.

Another object of the present invention is to provide a miniature puppet theater and book combination by which a child may, while reading, manipulate one or more puppet figures on an adjoining stage structure.

It is a further object of the present invention to provide a miniature puppet theater and book combination which is truly portable and easy for a child to set up and store and which is relatively inexpensive to manufacture.

A further object of the present invention is to provide a miniature puppet theater and book combination wherein a plurality of puppet figures of differing color, styles and type are color coordinated with portions of a stage structure and pages of an adjoining book.

Still a further object of the present invention is to provide a case for storing and transporting the miniature puppet theater and book combination according to the present invention.

Other and additional advantages will be apparent from the following description taken in conjunction with the accompanying drawings.

The foregoing and other objects of the present invention are carried out by a miniature puppet theater and book combination comprising a housing defining a stage, at least one puppet-like object for displaying on the stage of the housing in the manner of a puppet show, and a book connected to the housing and whose contents are related to the appearance of the puppet-like object. The housing preferably comprises collapsible front, side, rear and lower panels which may be collapsed together with the book into a relatively flat compact structure.

In one embodiment, the puppet-like object comprises a two-dimensional figure. The rear panel of the housing has a recess for releasably mounting the two-dimensional figure. In a collapsed state, the housing is collapsed together with the book into a relatively flat compact structure while the two-dimensional figure is mounted in the recess of the rear panel.

In another aspect, the present invention is directed to a case comprising a generally box-shaped structure having side, front, upper and lower panels connected together to define an interior space, and an intermediate panel disposed between the upper and lower panel to divide the interior space into a first compartment and a second compartment. At least one miniature puppet theater and book combination according to the present invention is disposed in the first compartment of the box-shaped structure. The case includes means providing access into the first compartment of the box-shaped structure for retrieving the miniature puppet theater and book combination from the first compartment.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENT

Figure 1:
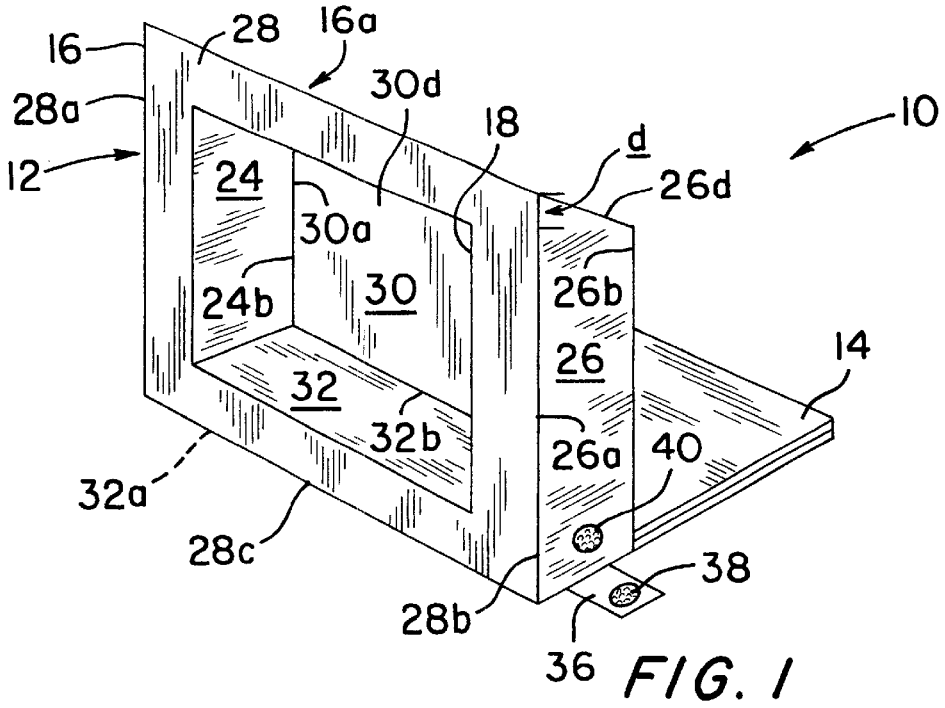
FIG. 1 is a front perspective view of a miniature puppet theater and book combination according to the present invention.

While this invention is susceptible of embodiments in many different forms, this specification and the accompanying drawings disclose only one form as an example of the use of the invention. The invention is not intended to be limited to the embodiment so described, and the scope of the invention will be pointed out in the appended claims.

Certain terminology is used in the following description for convenience only and is not intended to be limiting. The words right, left, front, rear, upper, lower, inner, and outer designate directions in the drawing to which reference is made. Such terminology includes the words above specifically mentioned and words of similar import.

Figure 2:
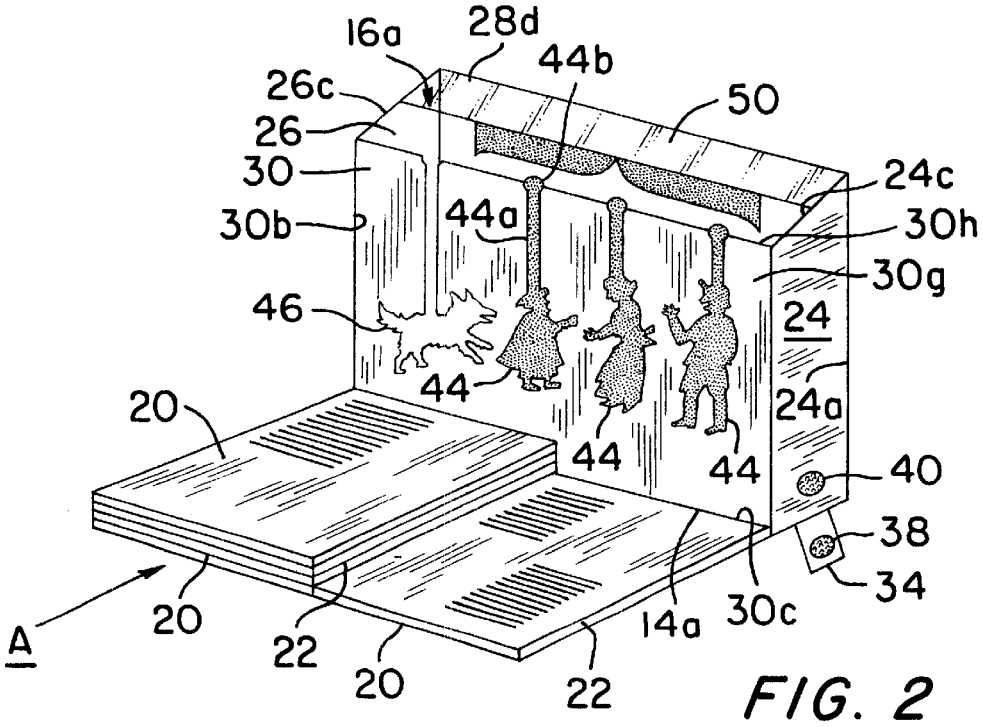
FIG. 2 is a rear perspective view of the miniature puppet theater and book combination according to the present invention.

Referring now to the drawings in detail, wherein like numerals are used to indicate like elements throughout, there is shown in FIGS. 1–3 and 4A–4F an embodiment of a miniature puppet theater and book combination, generally designated at 10, according to the present invention. FIGS. 1 and 2 are front and rear perspective views, respectively, of the miniature puppet theater and book combination 10 shown in an assembled state. The miniature puppet theater and book combination 10 comprises a stage structure, generally designated at 12, and a book 14 hinged to the stage structure 12. The stage structure 12 comprises a generally box-shaped housing 16 having a generally central opening 18 formed therein which defines a stage area of the miniature puppet theater. The book 14 has cover portions 20 and a plurality of pages 22 bound along edges therebetween.

The housing 16 may be formed from any suitable, inexpensive material, such as paper board, cardboard, plastic or the like and generally has side, front, rear and lower members or panels which are hinged together to form a collapsible box having an upper open end defining a slot 16*a* in the manner shown in FIGS. 1 and 2. More specifically, the housing 16 has a pair of side panels 24, 26, a front panel 28 having an edge 28*a* hinged to an edge 24*a* of the side panel 24 and an edge 28*b* hinged to an edge 26*a* of the side panel 26, a rear panel 30 having an edge 30*a* hinged to an edge 24*b* of the side panel 24 and an edge 30*b* hinged to an edge 26*b* of the side panel 26, and a lower panel 32 having an edge 32*a* hinged to an edge 28*c* of the front panel 28 and a free edge 32*b*. The book 14 has an upper edge 14*a* connected to a lower edge 30*c* of the rear panel 30 by a hinge so that, as further discussed below, the book 14 and the housing 16 may be collapsed into a flat compact structure. The lower panel 32 comprises a platform which can be folded about its hinged edge 32*a* and releasably secured to the side panels 24, 26 by suitable means to hold the side, front and rear panels of the housing 16 in assembled relation. The lower panel 32 also forms the central stage on which puppet-like characters and objects will be displayed through the opening 18 of the housing 16. The slot 16*a* of the housing 16 permits access to its interior for displaying and/or displacing the puppet-like characters and objects on the central stage in the manner of a puppet show, for example.

Figure 3:
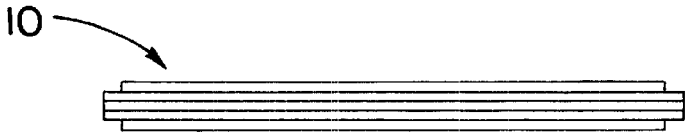
FIG. 3 is a side view of the miniature puppet theater and book combination according to the present invention shown in a folded state.

The side panels 24, 26, front panel 28, rear panel 30 and lower panel 32 of the housing 16 and the book 14 are interconnected as described above by hinges preferably fabricated of folded flat thin sheet stock. For example, the hinges may comprise W-shaped hinges of a width sufficient to permit the panels and the book to be folded together in coplanar abutment as shown in FIG. 3. Thus, it will be appreciated by those of ordinary skill in the art that the housing 16 is formed of collapsible side, front, rear and lower members which may be collapsed with the book into a relatively flat compact structure (i.e., a flat storage configuration), as shown in FIG. 3, for ease of transport and storage.

In the embodiment shown in FIGS. 1–2 and 4A–4F, the means for releasably securing the lower panel 32 to the side panels 24, 26 of the housing is a fastener such as a VELCRO fastener. For example, the lower panel 32 has tab portion 34, 36 extending from opposite sides thereof and each disposed adjacent a respective one of the side panels 24, 26. A strip 38 of the hook component of a VELCRO fastener is secured to an inner surfaces of each of the tab portions 34, 36. A corresponding strip 40 of a VELCRO loop component is secured to an outer surface of each of the side panels 24, 26 so that strips 38 and 40 of the VELCRO fastener mate together when the lower panel 32 is secured to the side panels 24, 26. It is understood by those of ordinary skill in the art that the means for releasably securing the lower panel 32 to the side panels 24, 26 is not limited to the structure shown in FIGS. 1, 2 and 4A–4F. Any other suitable means for releasably securing the lower panel 32 to the side panels 24, 26 may be used instead. For example, alternative embodiments may include snap connectors, zippers, buttons and hooks for releasably securing the lower panel 32 to the side panels 24, 26.

The rear panel 30 has an inner surface 30*d* provided with means for supporting one or more display members providing a scenic or other desired backdrop 80 (FIGS. 4B, 4E) which can be viewed through the opening 18 of the housing 16 during a theater presentation. As shown in FIG. 4F, for example, the means for supporting the backdrop 80 comprises a vertical groove formed by a pair of aligned slots 30*e*, 30*f* extending along the edges 30*a*, 30*b*, respectively, of the rear panel 30. The width of the aligned slots 30*e*, 30*f* is preferably selected so that the aligned slots can accommodate a plurality of backdrops 80 each of which can be selectively chosen for the particular theater presentation desired. For example, when a particular backdrop is desired, the display member corresponding to the desired backdrop is positioned in front of other display members disposed in the aligned slots 30*e*, 30*f* so that the selected display member can be viewed through the opening 18 of the housing 16 during a theater presentation. It is understood that structure other than aligned slots can be used for supporting the display members. For example, the display members may be removably secured to the front surface 30*d* of the rear panel 30 using hooks, pins, or a fastener, such as VELCRO fastener.

Referring now to FIG. 2, the rear panel 30 has an outer surface 30*g* provided with means for removably receiving and storing one or more two-dimensional hand actuated puppet figure 44 fabricated substantially of flat sheet stock material, such as cardboard, and presenting the general appearance of the front view of a person, animal or object, for example. Each of the puppet figure 44 preferably has a handle portion 44*a* which allows a puppeteer to manipulate the puppet figure by hand during a theatrical presentation. In the illustrated embodiment, the means for removably receiving and storing the puppet figure 44 to the rear surface 30*g* of the rear panel 30 comprises a plurality of recesses 46 formed in the rear surface 30*g*. Each recess 46 accommodates one of the puppet figure 44 and is formed with the general appearance of the front view of the person, animal or object which the puppet figure represents. Each of the puppet figure 44 is preferably formed with an enlarged end portion 44*b* which provides a means for removing the puppet figure from the recess 46. The enlarged end portion 44*b* of the puppet FIG. 44 is connected to the handle portion 44*a* and extends from an upper edge 30*h* of the rear panel 30 when the puppet FIG. 44 is disposed in the recess 46.

In the embodiment shown in FIG. 2, a recess 46 presenting the general appearance of the front view of an animal (e.g., a wolf) is shown in a state in which the corresponding puppet figure presenting the general appearance of the front view of the animal has been detached, while the remaining three puppet figure 44 are shown accommodated in a respective one of the recesses 46. The dimension of each recess 46 is selected so that the corresponding puppet FIG. 44 can be manually accommodated and retained therein by friction fit while allowing the puppet figure to be removed from the recess by hand (i.e., by manually grasping the enlarged end portion 44*b* and pulling away from the recess 46) for use during a theater presentation. Preferably, the flat sheet stock material of which the puppet figure 44 are fabricated is reasonably stiff, though sufficiently resilient to enable the puppet figures to bend to allow it to be repeatedly removed from and accommodated in the recess 46 during and after a theater presentation, respectively. Furthermore, the thickness of the flat sheet stock material of which the puppet figure 44 are fabricated corresponds substantially to the depth of the recesses 46 formed in the rear surface 30*g* of the rear panel 30 so that when the puppet figures are accommodated in the recesses the rear surface 30*g* of the rear panel 30 is substantially flat.

By the foregoing construction, it will be appreciated that the miniature puppet theater and book combination 10 can be easily compacted to a flat storage configuration amenable to packaging, as shown in FIG. 3. It will also be appreciated that the rear panel 30 provides a means for storing the puppet FIGS. 44 both when the miniature puppet theater and book combination 10 is in the flat storage configuration and in an assembled state during a theater presentation (e.g., when the puppet figure 44 are not being displayed on the stage area of the miniature puppet theater).

FIGS. 1–2 illustrate another feature of the miniature puppet theater and book combination 10 according to the present invention. As shown in FIG. 1, the height of the front panel 28 (i.e., dimension of the front panel 28 in the vertical direction in the assembled state of the miniature puppet theater and book combination shown in FIG. 1) is greater than that of the rear panel 30 by a preselected amount d. This difference in height is compensated by inclined upper edges 24*c*, 26*c* of side panels 24, 26, respectively, which interconnect the front panel 28 and the rear panel 30. During use, when the miniature puppet theater and book combination 10 in the assembled state shown in FIG. 2 is viewed by a user in the direction of arrow A, an upper section 28*d* of the front panel 28 is visible to the user. A reflecting material 50 is disposed on at least a portion of the upper section 28*d* of the front panel 28. The reflecting material 50 functions as a mirror which reflects at least a substantial portion of the stage area of the stage structure 12 to permit the user to view the puppet figures and movements thereof during a theater presentation. Thus, during a theater presentation, the user can view the stage area of the stage structure 12 by viewing the reflecting material 50. This allows the user to easily manipulate the puppet figure 44 in proper relation during the theater presentation.

Figure 4A:
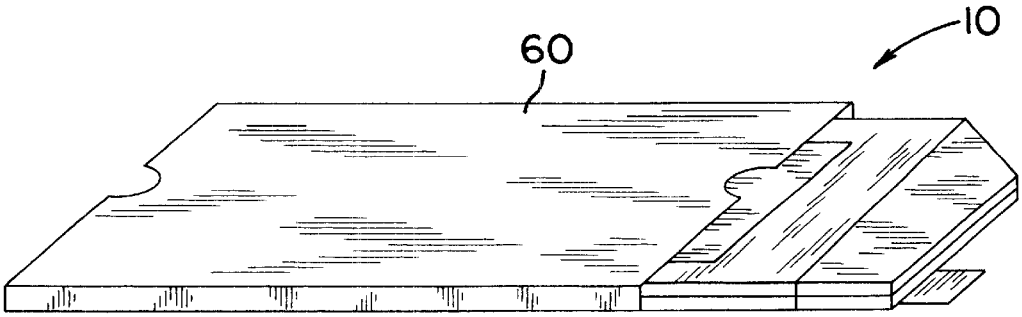
FIGS. 4A–4F show exemplary steps for assembling the miniature puppet theater and book combination from a flat storage configuration to an assembled configuration.
Figure 4B:
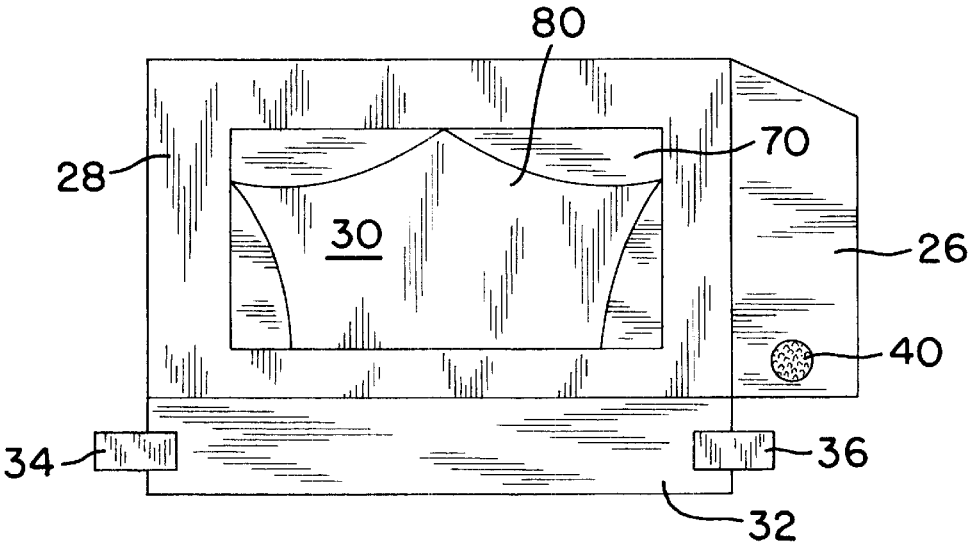
Figure 4C:
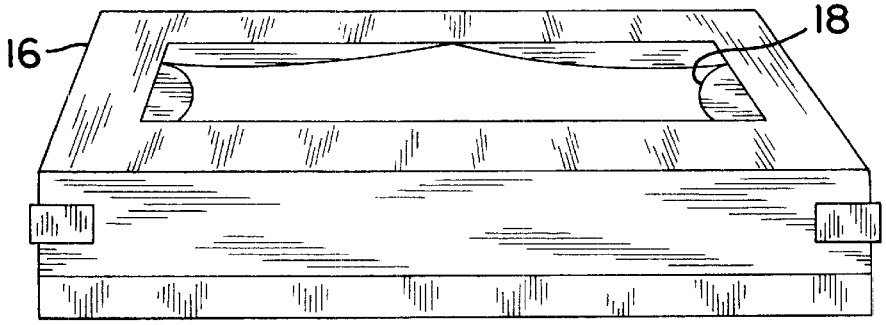
Figure 4F:
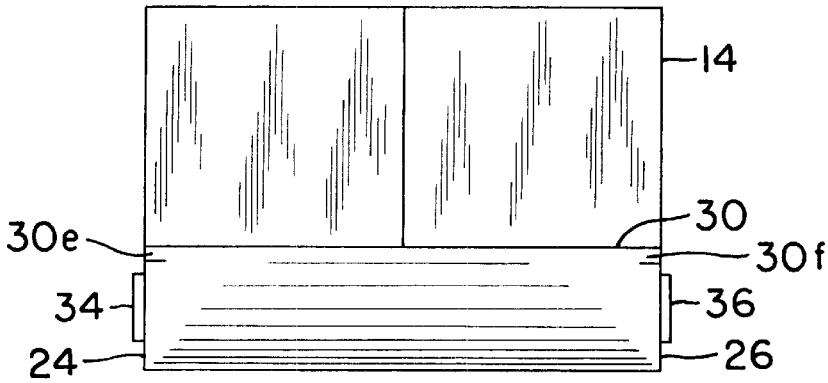

FIGS. 4A–4F show exemplary steps for assembling the miniature puppet theater and book combination 10 from a flat storage configuration to an assembled configuration. In FIG. 4A, the miniature puppet theater and book combination 10 is shown in a flat storage configuration and partially inserted in a protective sleeve 60. The protective sleeve 60 is formed from any suitable, inexpensive material, such as paper board, cardboard, plastic or the like and provides a means for storing and protecting the miniature puppet theater and book combination 10 in its flat storage configuration.

Figure 4D:
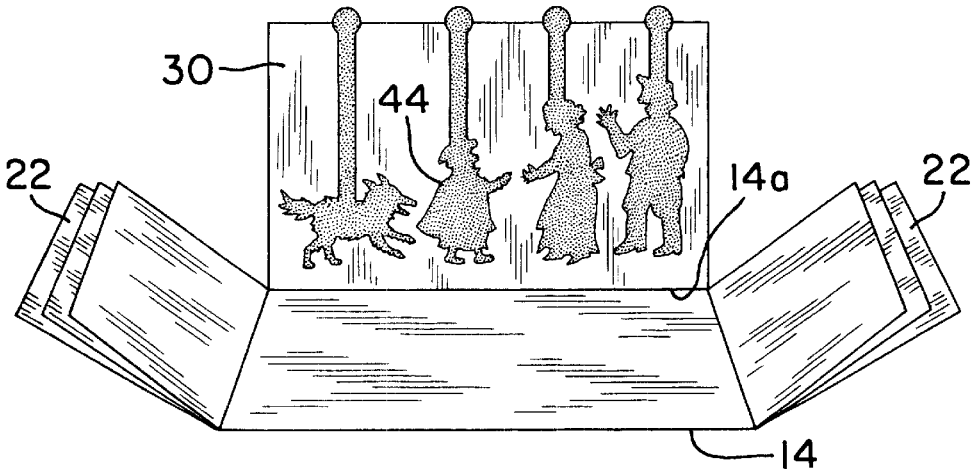

After being removed from the protective sleeve 60, the miniature puppet theater and book combination 10 is unfolded from its flat storage configuration by folding the side panels 24, 26, front panel 28, rear panel 30, and lower panel 32 about respective hinge edges (FIG. 4B) to form the generally box-shaped housing 16 having the central opening 18 as shown in FIG. 4C. From the state shown in FIG. 4C, the entire housing 16 is folded about the hinge connecting the upper edge 14*a* of the book 14 to the lower edge 30*c* of the rear panel 30 to place the housing 16 in a vertical position as shown in FIG. 4D. This vertical position of the housing 16, which is also shown in FIGS. 1 and 2, is the operational position of the housing during use of the miniature puppet theater and book combination 10.

Figure 4E:
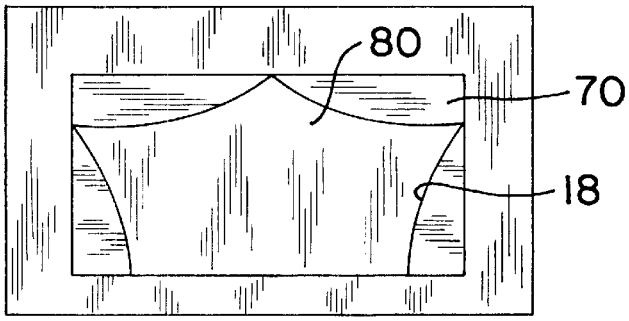

FIG. 4D illustrates a view of the miniature puppet theater and book combination 10 from the point of view of the user during a theatrical presentation. For illustration purposes, only the rear panel 30 of the housing 16 is depicted in FIG. 4D with the puppet figure 44 being accommodated in the recesses 46 of the rear panel 30. The book 14 with its pages 22 is shown in an open state. FIG. 4E illustrates a view of the miniature puppet theater and book combination from the point of view of an audience viewing the theatrical presentation. FIG. 4F is a top view of the miniature puppet theater and book combination in the assembled configuration with the book 14 shown in a closed state. It will be appreciated from the foregoing construction that during a theatrical presentation, the presenter (e.g., a child) may, while reading, manipulate one or more of the puppet figures in the stage area of the stage structure 12.

As shown in FIG. 4E, the miniature puppet theater and book combination 10 presents to the audience the appearance of a conventional stage with stage curtains 70 and backdrop 80. The curtains 70 may be constructed of the same or a different material from which the housing 16 is constructed. If constructed from a different material as the housing 16, the curtains 70 may be attached to the housing 16 around the opening 18 using suitable connecting means, such as adhesive tape, adhesive glue or staples. In an alternative embodiment, the curtains 70 are constructed from the same piece of material from which the housing 16 is constructed.

The backdrop 80 can be paper with a desired scene drawn or painted thereon. Numerous backdrops 80 can be provided and selectively used. The backdrops 80 can be created by the puppeteer or premanufactured to more realistically simulate real theater. Furthermore, it may be desired, for example, to provide backdrops onto which scenes have been drawn or printed but not colored. Coloring can then be done by a child in preparation for use.

The covers 20 and pages 22 of the book 14 may be printed or otherwise marked with letters, pictures, numbers or other indicia which is printed thereon in any suitable manner and relate to the puppet figure 44. The colors and design for the covers 20 and pages 22 of the book 14 are preferably selected to coordinate with the colors and design of the respective protective sleeve 60 in which the miniature puppet theater and book combination 10 is stored in its flat storage configuration in order to keep with a desired theme. Further, it is desired that the outside rear surface of the covers 20 and/or the protective sleeve 60 include a title or other label identifying the miniature puppet theater and book combination. The covers 20 and pages 22 of the book 14 can also support other materials with different textures. For example, the text and images may be embroider onto the cover and pages of the book.

Each of the two-dimensional puppet figure 44 preferably comprises a flat object and is fabricated of flat sheet stock material, such as cardboard, into a flat panel. Preferably, the flat sheet stock material of which each of the puppet figure 44 is fabricated is reasonably stiff, though sufficiently resilient to enable the puppet figures to be repeatedly handled by the puppeteer during a theater presentation and during insertion into and removal from the recess 46 without damage to the puppet figure. The flat panel is contoured and decorated in any manner to represent different characters, preferably in keeping with a story told in the printed matter or illustrations on the pages 22 of the book 14. For example, when the puppet takes the form of an animal, such as a wolf shown in FIGS. 2 and 4D, the flat panel will generally contain indicia or other suitable ornamentation to represent the head, body, legs, eyes, etc., of the wolf. The printing on the pages 22 of the book 14 is then designed to provide a story which relates to the wolf. In another example, when pages 22 of the book 14 contains text and features relating to how an airplane works, one or more of the puppet figure 44 has the form of an airplane.

Moreover, the book may take the form of other types of literary materials, such as a game, an instructional program or a coordinated system wherein the puppet figure 44 are associated with and supplement the content of the literary material. For example, if the literary material is of an instructional nature aimed at word recognition, the puppet figure 44 may depict letters of the alphabet or short words. Furthermore, the side panels 24, 26, front panel 28, rear panel 30 and lower panel 32 of the housing 16, the sleeve 60, the curtains 70, and/or the backdrops 80 may be decorated in any manner, preferably in keeping with the form of the puppet figures and with the story told in the printed matter or illustrations on the pages 22 of the book 14.

Assembly of the miniature puppet theater and book combination 10 according to the present invention is simple and easy and takes but a few moments. First, a desired area for assembling the miniature puppet theater and book combination is selected, such as a floor or table surface. The miniature puppet theater and book combination 10 is then removed from the protective sleeve 60 shown in FIG. 4A. The miniature puppet theater and book combination 10 is then unfolded from its flat storage configuration shown in FIG. 3 by folding the side panels 24, 26, front panel 28, rear panel 30, and lower panel 32 about respective hinge edges (FIG. 4B) to form the generally box-shaped housing 16 having the central opening 18 (FIG. 4C). From the state shown in FIG. 4C, the entire housing 16 is folded about the hinge connecting the upper edge 14*a* of the book 14 to the lower edge 30*c* of the rear panel 30 to place the housing 16 in a vertical position as shown in FIG. 4D. This vertical position of the housing 16, which is also shown in FIGS. 1 and 2, is the operational position of the housing during use of the miniature puppet theater and book combination 10. The puppeteer then selects an appropriate backdrop 80 which corresponds to the contents of the book and puppet figures and inserts the selected backdrop 80 into the vertical groove defined by the aligned slots 30*e*, 30*f* of the rear panel 30. The miniature puppet theater and book combination is then ready for conducting a theatrical presentation.

FIG. 4D illustrates a view of the miniature puppet theater and book combination 10 from the point of view of the user during a theatrical presentation. During a theatrical presentation, with reference to FIGS. 1–2, the puppeteer simply removes one or more of the puppet figure 44 from the recesses 46 of the rear panel 30 and locates the puppet figures on the stage area of the stage structure 12 through the slot 16*a* of the housing while manually holding the handle portion 42*a* and the enlarged portion 42*b* of the puppet figures. After the audience is comfortably seated in front of the stage structure 12, the puppeteer displaces or manipulates the puppet figure 44 on the stage area in accordance with the contents of the book 14 and the backdrop 80. As described above, during the theater presentation the puppeteer can view the stage area of the stage structure 12 through the reflecting material 50 disposed on the inner surface of the front panel 28 of the housing 16. This allows the puppeteer to easily manipulate the puppet figure 44 on the stage area in proper relation during the theatrical presentation. FIG. 4E illustrates a view of the miniature puppet theater and book combinations 10 from the point of view of an audience viewing the theatrical presentation. It can be appreciated from FIGS. 4D and 4E that the book 14 remains behind the stage structure 12 during the theatrical presentation.

Figure 6:
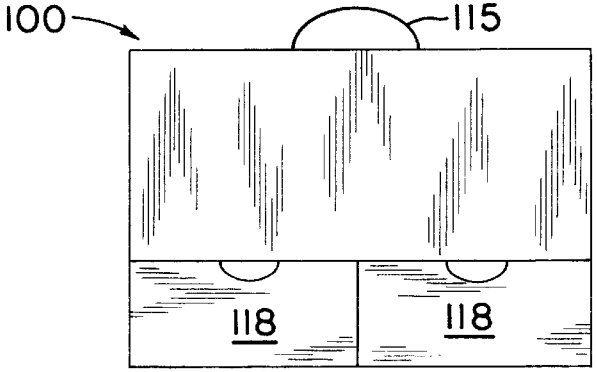
FIG. 6 is a rear view of the case shown in FIG. 5.
Figure 5:
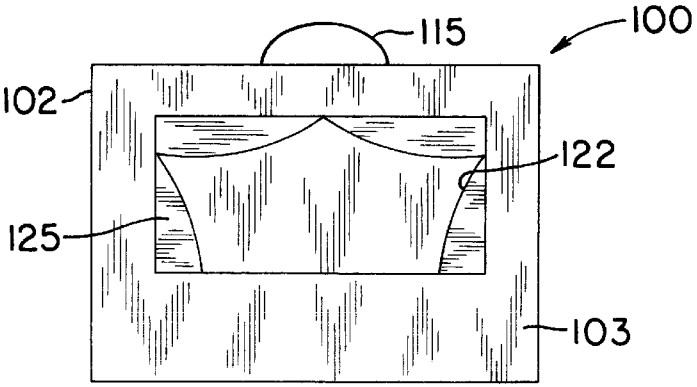
FIG. 5 is a front view of case according to the present invention for storing and transporting one or more of the miniature puppet theater and book combination according to the present invention.
Figure 8:
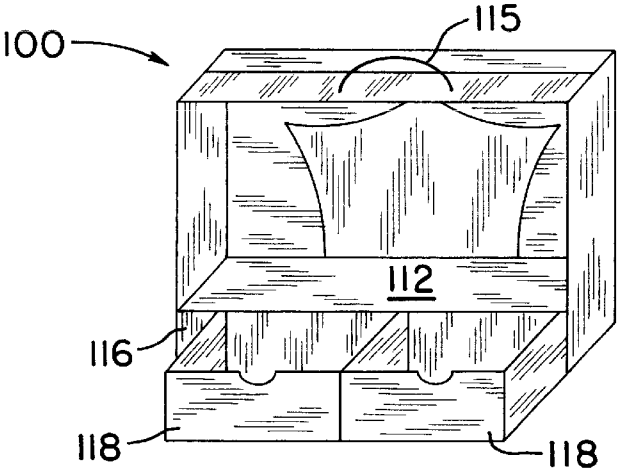
FIG. 8 is a rear perspective view of the case according to the present invention with drawers in the opened position and the rear cover removed.
Figure 7:
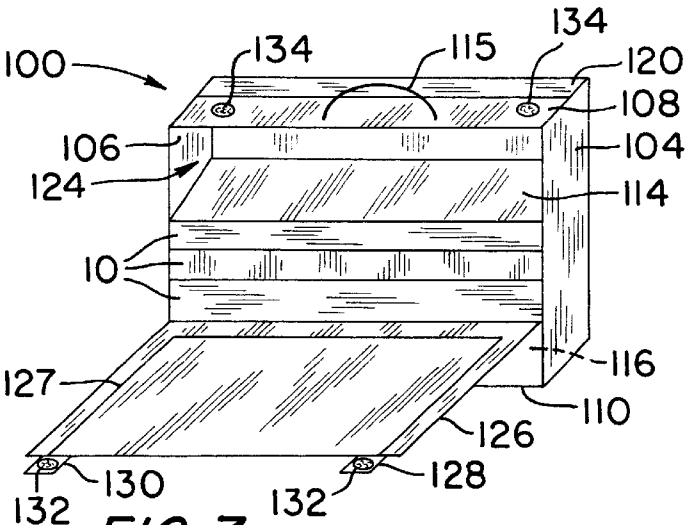
FIG. 7 is a rear perspective view of the case according to the present invention with a rear cover in the opened position.

FIGS. 5–8 show a case, generally designated at 100, for storing and transporting one or more of the miniature puppet theater and book combinations 10 according to the present invention, where FIG. 5 is a front view of the case 100, FIG. 6 is a rear view of the case shown in FIG. 5, and FIGS. 7–8 are rear perspective views of the case. The case 100 comprises a generally box-shaped structure 102 having a front panel 103, side panels 104, 106, an upper panel 108, and a lower panel 110 all connected together to define an interior space. An intermediate panel 112 is disposed between the upper and lower panels 108, 110. As shown in FIGS. 8, the intermediate panel 112 is disposed generally horizontal to the upper panel 108 and the lower panel 110 and is connected to the side panels 104, 106 to divide the interior space of the box-shaped structure 102 into a first compartment 114 and a second compartment 116. The first compartment 114 is dimensioned to receive and store one or more miniature puppet theater and book combination 10 according to the present invention. For example, in FIG. 7 three of the miniature puppet theater and book combinations 10, each of which is in a flat storage configuration and is inserted in the protective sleeve 60, are disposed in the first compartment 114. In the illustrated embodiment, the second compartment 116 is dimensioned to receive a pair of drawers 118 for storing puppet figure 44 or other accessory that may be used in conjunction with the miniature puppet theater and book combination 10.

The upper panel 108 extends between the side panels 104, 106 but preferably does not cover the entire upper end of the case 100 so that an opening 120 is formed which permits visual access into the first compartment 114 from the upper end of the case 100. A handle 115 is connected to the upper panel 108 so that the case can be easily carried to and from a desired location for use during a theatrical presentation. The front panel 103 has an opening 122 for displaying each of the miniature puppet theater and book combinations 10 stored in the primary compartment 114. Preferably, the miniature puppet theater and book combinations 10 are stored in the primary compartment 114 so that any title or other label on the protective sleeve 60 which identifies the miniature puppet theater and book combination can be viewed by the user through the opening 122 of the front panel 103. The opening 122 may be decorated with curtains 125 so as to present the appearance of a stage when the case 100 is viewed as shown in FIG. 5.

Referring back to FIG. 7, the case 100 has a rear opening 124 which permits access into the first compartment 114 for storing and removing the miniature puppet theater and book combinations 10, a cover member 126 comprised of a rear panel hinged to a connecting edge of the lower panel 112 for opening and closing the rear opening 124, and means for detachably securing the cover member 126 to the upper panel 108. The cover member 126 and the lower panel 112 are interconnected by a hinge (not shown) preferably fabricated of folded flat thin sheet stock. For example, the hinge may comprise a W-shaped hinge as described above for the construction of the housing 16 of the miniature puppet theater and book combination. The hinge should have a width sufficient to permit the cover member 126 to be folded about the connecting edge of the lower panel 112 when the cover member 126 is secured to the upper panel 108. A generally U-shaped groove 127 is preferably formed on the inner surface of the cover member 126 for storing one or more of the display members or backgrounds 80 of the miniature puppet theater and book combination.

In the illustrated embodiment, the means for detachably securing the cover member 126 to the upper panel 108 is a fastener such as a VELCRO fastener. For example, the cover member 126 has tab portions 128, 130 extending from an upper edge thereof, each of which supports a strip 132 of a hook component of a VELCRO fastener. Corresponding strips 134 of a VELCRO loop component are secured to an outer surface of the upper panel 108 so that strips 132, 134 of the VELCRO fastener mate together when the cover member 126 is secured to the upper panel 108. It is understood by those of ordinary skill in the art that the means for detachably securing the cover member 126 to the upper panel 108 is not limited to the structure shown in FIG. 7. For example, snap connectors, zippers, buttons and hooks are also suitable for detachably securing the cover member 126 to the upper panel 108.

The panels, cover member and drawers of the case 100 may be formed from any suitable, inexpensive material, such as paper board, cardboard, plastic or the like. The curtains 125 may be constructed of the same or a different material from which the panels, cover member and drawers of the case 100 are constructed. If constructed from a different material, the curtains 125 may be attached to the front panel 103 around the opening 122 using suitable connecting means, such as adhesive tape, adhesive glue or staples.

The case 100 may be decorated with indicia or other suitable ornamentation in the manner described above for the book 14, housing 16, puppet figure 44, protective sleeve 60 and/or backdrops 80 of the miniature puppet theater and book combination 10. It will be appreciated by those of ordinary skill in the art that obvious variations on the content and manner of presentation of the components of the case 100 and the miniature puppet theater and book combinations 10 described above are considered to be within the scope of the instant invention. In this regard, a nearly limitless variety of designs for the case 100, the book 14, the housing 16, the puppet figure 44, the curtains 70 and the backdrops 80 can be selected for use in connection with the present invention.

In another aspect, use of the miniature puppet theater and book combination according to the present invention can be combined with an audio presentation which complements the theatrical presentation. For example, if the theatrical presentation relates to how an airplane works, as described above, the audio presentation could provide sounds relating to airplanes during flight. The audio presentation can be provided using audio cassettes or CDs which may be stored in the drawers of the case and played during a theatrical presentation.

It will be appreciated by those skilled in the art that obvious changes can be made to the embodiment described in the foregoing description without departing from the broad inventive concept thereof. For example, the puppet figure 44 may be stored in the drawers 118 of the case 100 instead of the rear panel 30 of the housing 16. In this case, it is not necessary to form recesses 46 on the surface of the rear panel 30 for accommodating the puppet figure 44, thereby reducing the cost of fabricating the housing 16. Furthermore, three-dimensional puppet figures may be used instead of or in addition to the one-dimensional puppet figure 44. For example, miniature three-dimensional puppet figures (not shown) representing different characters, such as animals, persons, or things can be used during a theatrical presentation and can be stored in the drawers 118 of the case 100 when they are not used. The three-dimensional puppet figures may formed of a plastic, fabric or other suitable material.

The miniature puppet theater and book combination according to the present invention can be used by adults and/or children of all ages. Where a child and an adult jointly use the miniature puppet theater and book combination, the child may manipulate one or more of the puppet figures while the adult reads the book, or vice versa. The term "read" is used herein in its broadest sense to cover situations where the child is too young to actually read but can look at pictures on the pages of the book and manipulate the puppet figures, as well as situations where there may not be any printed words as such on the pages of the book, or situations where portions of the story printed on the pages of the book are left unprinted to allow the child to participate in use of the combination by imaginatively completing or resolving the story or situation partially illustrated.

Thus, the present invention provides a miniature puppet theater and book combination which is well suited for use by children or even adults. The miniature puppet theater and book combination can be economically manufactured, easily stored, shipped, or carried by a child to a playmate's home whereupon the miniature puppet theater and book combination can be readily assembled for use and disassembled into a flattened configuration for storage and transport. Additionally, the miniature puppet theater and book combination has provision for backdrops which can be created by the puppeteer or premanufactured to more realistically simulate a real theater.

From the foregoing description, it can be seen that the present invention comprises an improved miniature puppet theater and book combination and a case for storing and transporting the same. It will be appreciated by those skilled in the art that obvious changes can be made to the embodiments described in the foregoing description without departing from the broad inventive concept thereof. It is understood, therefore, that this invention is not limited to the particular embodiment disclosed, but is intended to cover all obvious modifications thereof which are within the scope and the spirit of the invention as defined by the appended claims.

I claim:

1. A miniature puppet theater and book combination, comprising: a housing defining a stage and having collapsible front, side, rear and lower panels; at least one puppet-like object displaceable on the stage of the housing in the manner of a puppet show; and a book whose contents are related to the appearance of the puppet-like object and being connected to the housing so that the front, side, rear and lower panels of the housing are collapsible together with the book into a relatively flat compact structure.

2. A miniature puppet theater and book combination according to claim 1; wherein the puppet-like object comprises a two-dimensional figure; and wherein the rear panel of the housing has a recess for removably receiving therein the two-dimensional figure for storing the same.

3. A miniature puppet theater and book combination according to claim 2; wherein in the collapsed state, the housing is collapsed together with the book into a relatively flat compact structure while the two-dimensional figure is mounted in the recess of the rear panel.

4. A miniature puppet theater and book combination according to claim 3; further comprising a sleeve for storing the housing, the book and the two-dimensional figure in the collapsed state.

5. A miniature puppet theater and book combination according to claim 1; further comprising a sleeve for storing the housing and the book in the collapsed state.

6. A miniature puppet theater and book combination according to claim 1; wherein the puppet-like object comprises a three-dimensional figure.

7. A miniature puppet theater and book combination according to claim 1; further comprising display means for displaying a desired backdrop scene on the stage of the housing.

8. A miniature puppet theater and book combination according to claim 1; further comprising a hinge connecting the housing and the book together.

9. A miniature puppet theater and book combination according to claim 1; wherein the at least one puppet-like object comprises a plurality of puppet-like objects each shaped and arranged to represent a distinct object displaceable on the stage of the housing in the manner of a puppet show.

10. A miniature puppet theater and book combination according to claim 1; further comprising means for removably receiving the puppet-like object for storing the same.

11. A miniature puppet theater and book combination, comprising: a housing defining a stage and comprised of collapsible front, side, rear and lower panels which may be collapsed into a relatively flat compact structure; one or more puppet-like objects removably mounted on the rear panel of the housing and displaceable on the stage of the housing in the manner of a puppet show; and a book connected to the housing and having a plurality of pages whose contents are related to the one or more puppet-like objects.

12. A miniature puppet theater and book combination according to claim 11; further comprising connecting means for connecting the housing and the book so that the book and the housing define the flat compact structure in the collapsed state.

13. A miniature puppet theater and book combination according to claim 12; wherein the connecting means connects the book to the rear panel of the housing.

14. A miniature puppet theater and book combination according to claim 11; wherein the one or more puppet-like objects comprises at least one two-dimensional figure; and wherein the rear panel of the housing has a recess for detachably mounting therein the two-dimensional figure.

15. A case comprising: a generally box-shaped structure having side, front, upper and lower panels connected together to define an interior space, and an intermediate panel disposed between the upper and lower panels to divide the interior space into a first compartment and a second compartment; at least one miniature puppet theater and book combination according to claim 1 disposed in the first compartment of the box-shaped structure; and means providing access into the first compartment of the box-shaped structure for retrieving the miniature puppet theater and book combination from the first compartment.

16. A case according to claim 15; further comprising at least one drawer disposed in the second compartment of the box-shaped structure for storing the puppet-like object of the miniature puppet theater and book combination.

17. A case according to claim 15; further comprising means defining an opening in the front panel of the box-shaped structure for viewing the miniature puppet theater and book combination disposed in the first compartment of the box-shaped structure.

18. A case according to claim 15; wherein the means providing access into the first compartment of the box-shaped structure comprises an opening formed by the upper, side and intermediate panels of the box-shaped structure, and a cover member for opening and closing the opening.

19. A case according to claim 18; wherein the cover member has a first edge connected to the intermediate panel of the box-shaped structure; and further comprising means for releasably connecting a second edge of the intermediate panel opposite the first edge thereof to the upper panel of the box-shaped housing.

* * * * *